United States Patent [19]

Evanson

[11] 4,328,598

[45] May 11, 1982

[54] MATTRESS FOUNDATION WITH VIBRATOR

[75] Inventor: Robert Evanson, Spokane, Wash.

[73] Assignee: Northwest Bedding Co., Spokane, Wash.

[21] Appl. No.: 153,275

[22] Filed: May 27, 1980

[51] Int. Cl.[3] ..... A47C 19/00; A47D 9/02

[52] U.S. Cl. ..... 5/401; 5/109

[58] Field of Search ..... 5/400, 401, 108, 109, 5/508; 128/33

[56] References Cited

U.S. PATENT DOCUMENTS

| | | | |
|---|---|---|---|
| 2,980,108 | 4/1961 | Scott | 5/109 |
| 3,311,935 | 4/1967 | Petty | 5/109 |
| 3,506,986 | 4/1970 | Lovette | 5/401 |
| 4,112,529 | 9/1978 | Golembeck et al. | 5/401 |

*Primary Examiner*—Alexander Grosz

*Attorney, Agent, or Firm*—Wells, St. John & Roberts

[57] ABSTRACT

A mattress foundation having a rigid frame covered at least in part by a continuous stationary horizontal top surface. A layer of resilient material overlies the stationary top surface. An open grid freely rests on this layer and is resiliently supported by it. A powered vibrator unit is fixed to the grid and is physically clear of contact with the frame. The grid is resiliently covered. It is capable of imparting vibratory movement about the top surface of the completed foundation assembly. In one form, a section of the grid is resiliently supported on the frame by interposed upright springs.

8 Claims, 4 Drawing Figures

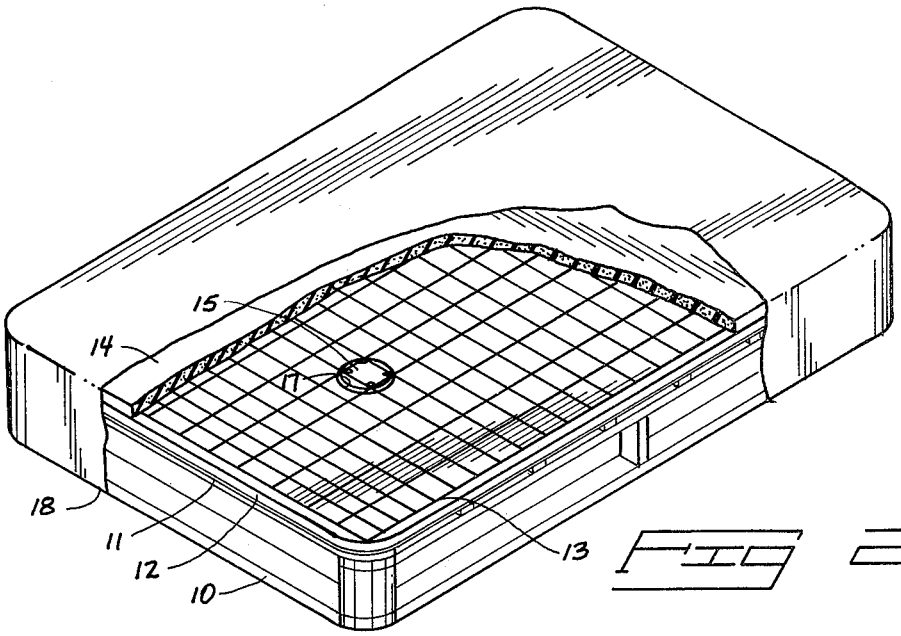
FIG 2
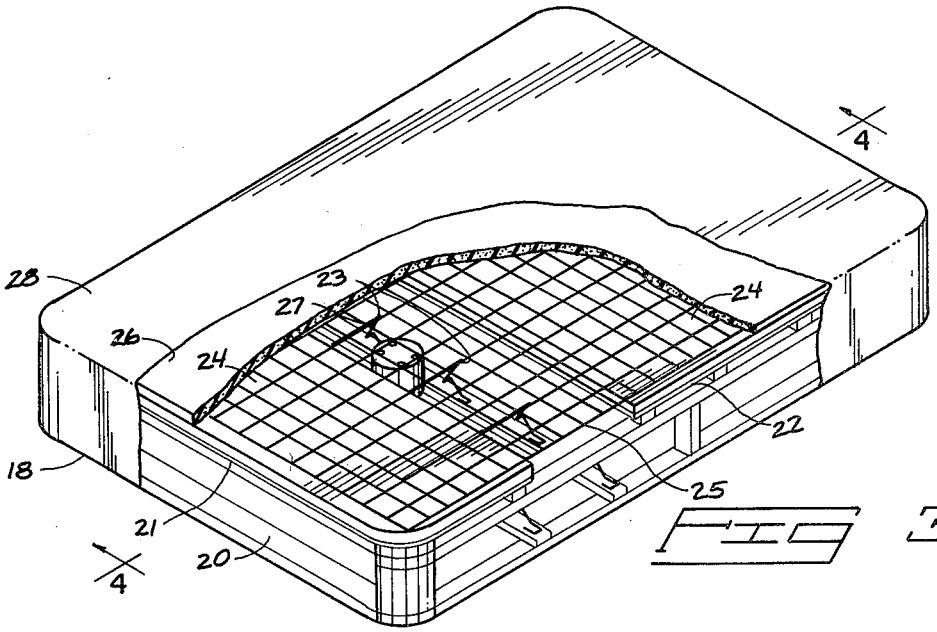
FIG 3
FIG 4
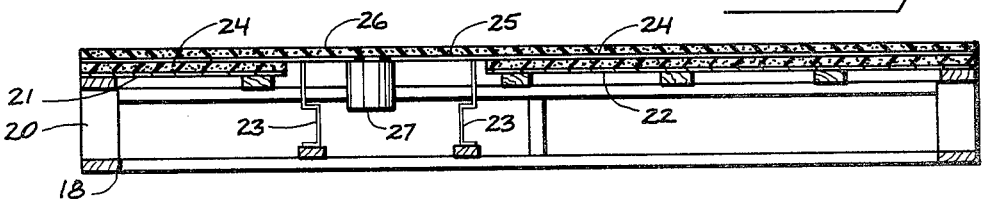

MATTRESS FOUNDATION WITH VIBRATOR

BACKGROUND OF THE INVENTION

This invention relates to a mattress foundation of the rigid "platform" type, which provides horizontal support for a mattress along a normally stationary top surface. It can be used for support of conventional innerspring or padded mattresses, foam mattresses, and waterbed mattresses.

Foundations of the platform type are used by many people who desire a firm mattress support. Because of their rigid nature, platforms are not susceptible to the fatigue and wear encountered during use of boxsprings. A platform, if properly constructed, will retain its normal horizontal configuration throughout its expected life. Platform foundations are also economical since they can be produced as a fixed frame assembly without incorporating springs. This substantially minimizes both labor and material costs in comparison to construction costs involved in production of conventional boxspring foundations.

This invention relates specifically to the incorporation of an electro-mechanical vibrator unit into a platform foundation. Such vibrator units have been previously incorporated within innerspring foundations by attaching the vibrator unit to the upper grid of the boxspring assembly. Operation of the vibrator unit imparts vibratory movement to the grid fixed to the supporting springs, and in turn is thereby imparted to the mattress and user resting upon such a foundation.

It has been found impractical to mount a vibratory unit directly to a rigid platform. First, the rigidity of the platform suppresses most of the vibratory movement. More importantly, vibration tends to damage the structure of a rigid platform by loosening the joints and connections between the various platform components.

The present invention combines a platform structure with a vibratory unit in such a manner as to isolate the vibratory movement from the rigid platform frame. It retains the cost advantages of other platform assemblies, while providing the added accessory of a vibratory unit. It is capable of successfully imparting the desired amount of vibratory movement to a mattress supported upon it.

DESCRIPTION OF THE DRAWINGS

FIG. 2 is a top perspective view of the platform foundation with a portion of its upper layers broken away;

FIG. 3 is a view similar to FIG. 2, showing a second form of the invention; and FIG. 4 is a longitudinal cross-sectional view taken substantially along line 4—4 in FIG. 3.

DESCRIPTION OF THE PREFERRED EMBODIMENTS

Figure 1:
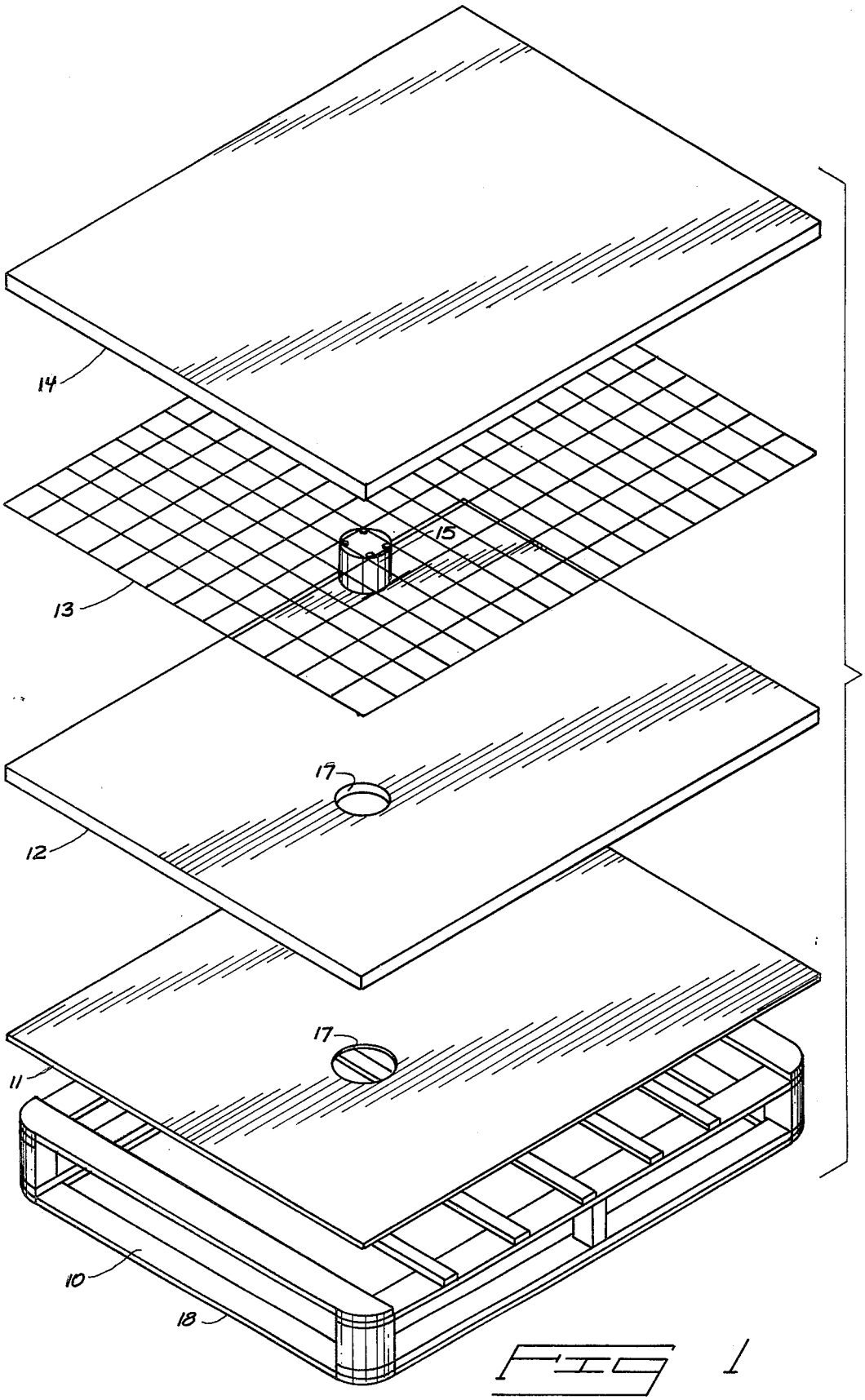
FIG. 1 is a partial exploded view of a first embodiment of the invention.

FIG. 1 illustrates the basic construction of a first embodiment of the invention, also shown in perspective in FIG. 2. FIGS. 3 and 4 show a second form of the invention.

FIGS. 1 and 2 disclose a foundation having a full area platform surface. It includes a rigid wood or metal frame 10 covered by a stationary layer of fiberboard, cardboard, plywood or other substantially rigid sheet material shown at 11. The sheet of material 11 is glued or fastened across the top of frame 10. It presents a continuous horizontal top surface fixed to the frame.

The frame 10 illustrated in the drawings is constructed of wood boards, including horizontal transverse top slats which directly engage and support the underside of sheet 11. Any suitable type of box frame structure can be substituted for that specifically illustrated.

A first layer of resilient material, illustrated as a sheet 12 of foamed resin, overlies and completely covers the upper surface of sheet 11. The resilient sheet 12 can be made of urethane foam, or other compatible resilient foam of natural or synthetic origin. It might also be a layer of fibrous padding or a combination of resilient materials. It simply rests on the upper surface of sheet 11 and is preferably not attached to it, although attachment of sheet 12 to sheet 11 can be accomplished by adhesives should be desired.

Overlying the top surface of the foam sheet 12 is a metal grid 13. Grid 13 is illustrated as being an open planar grid freely resting on the first layer of resilient material at 12.

Grid 13 is unattached to the frame 10 or sheet 11. It is typically made from intersecting wires welded to one another. While it is somewhat flexible perpendicular to its area, grid 13 is substantially rigid in its structural plane, which is arranged horizontally in the illustrated assembly. Grid 13 can be constructed from conventional material used in the mattress foundation industry for attachment of coils across the top of a boxspring unit. Grid 13 can be made from other sheet materials, such as perforated particleboard, and can be molded or formed from resin materials. The purpose of grid 13 as used herein is to transmit vibrations throughout the horizontal area of the foundation upper surface.

Grid 13 is covered by a second layer 14 of sheet foam material, which can be identical to the layer 12, or again can be any suitable padded material. It should be capable of frictionally engaging the open grid 13 and suitably padding the metal grid 13 to assure that grid 13 will not show through the outer foundation cover.

Grid 13 has a vibrator unit 15 fixed to it. The location of the vibrator unit 15 within the area of grid 13 is not of vital consequence, but it is preferably located toward the "head" of the foundation so as to provide a center of vibration beneath the bodies of those using it. It can be located at the transverse center of the foundation, or toward one side (as illustrated).

The vibrator unit 15 is of a type conventionally used today in the vibration of boxspring foundations. It includes a rotational electric motor with an internal eccentric weight that imparts horizontal vibratory movement to the unit 15. This is transmitted directly onto the grid 13, to which unit 15 is fixed by clamping screws. The vibrator unit 15 is typically provided with an electric cord (not shown) for attachment to a suitable source of electric power.

The vibrator unit 15 is loosely and freely received within apertures 17 vertically aligned and formed through the foam sheet 12 and planar sheet 11 across frame 10. The unit 15 is located within the enlarged apertures 17 so as to remain physically clear of contact with the frame 10. This positioning is assured by the sandwiching of grid 13 between the resilient sheets 12, 14 in the completed assembly. Contact of frame 10 by the vibrator unit 15 is undesirable, since it would result in a high noise level and possible damage to the structure of frame 10.

The foundation is completed by a fabric cover of conventional ticking. This cover envelops and is fitted over the top and sides of frame 10, the resilient foam sheets 12, 14, and grid 13. The cover is fastened to the frame 10 about its bottom surface 18. Surface 18 is a peripheral bottom surface formed on the frame 10 parallel to its top surface across the sheet 11. Such cover assemblies are well known in the foundation industry. The foundation can be completed by provision of a layer of light sheeting (not shown) across the bottom of frame 10.

The desired assembly is capable of imparting vibrational movement across the full top area of the foundation without vibrating the rigid frame 10. Grid 13 is resiliently isolated from the frame 10 by the interposed foam sheets 12, 14. Grid 13 therefore "floats" freely across the frame 10 and can vibrate without restriction or possible damage to the structural frame elements. Vibratory movement is efficiently imparted across the top surface of cover 16, and can be transmitted from the foundation to any suitable mattress (not shown) resting upon it. This foundation is particularly adaptable to waterbeds, which typically require the strength of a rigid platform for vertical support. However, the foundation can be used in conjunction with any type of mattress, including innerspring mattresses, fiber filled mattresses, foam mattresses or mattresses constructed of a combination of these or other similar resilient materials.

FIGS. 3 and 4 show a slightly modified form of the invention. The frame 20 again is illustrated as being constructed from wood boards in a box-type configuration. However, the positioning of the transverse upper slats is interrupted along the length of the foundation to provide space for one or more intermediate transverse rows of upright yieldable springs 23. Springs 23 are operably connected between frame 20 and an open metal grid 25 identical to the previously-described grid 13. The remaining areas of frame 20 are covered by substantially rigid planar sheets 21, 22 which are fixed to the upper surfaces of frame 20 across the head and foot of the foundation.

Foam sheets 24 are loosely interposed between grid 25 and the upper surfaces of sheets 21, 22 to resiliently isolate grid 25 from the supporting horizontal platform surfaces of the foundation. A second continuous layer of resilient material, shown as a foam sheet 26, overlies grid 25 about its complete horizontal area. A vibrator unit 27, identical to the previously described vibrator unit 15, is fixed to grid 25 in the area of the springs 23. The foundation is completed by a cover 28.

This second embodiment comprises a hybrid foundation wherein a portion of the foundation area is of rigid platform construction, and its remaining area is provided by conventional boxspring construction. This boxspring area provides yieldable support across a selected portion of the foundation area. It might be located beneath the heavier portions of the bodies resting upon the completed bed assembly. Since the springs 23 are fastened to grid 25, they yieldably locate grid 25 relative to frame 20, permitting limited horizontal movement in addition to yieldable vertical movement. Again, grid 25 is otherwise unattached to frame 20 and is free to vibrate in a horizontal plane in response to operation of the vibrator unit 27.

It is to be understood that any type of upright springs might be used between grid 25 and frame 20 in the open portion of the platform. While a specific type of conventional spring is illustrated, coil springs can be utilized as well.

In both forms of the invention, the foundation basically includes a rigid frame having continuous horizontal top surface areas. A first layer of resilient material overlies the top surface area of the frame. The open grid rests freely on this first layer of resilient material and is unattached to the rigid supporting frame. The vibrator unit is fixed to the grid and is physically clear of contact with the rigid structural frame.

The foundation provides platform support for a covering mattress of any desirable configuration. The electrical vibrator unit is capable of transmitting vibrations from the foundation to a supported mattress (not shown). Vibratory movement can be safely and effectively imparted from this platform foundation to the mattress assembly without the risk of resulting structural damage to the platform frame. This provides a practical and economical foundation for support of a mattress, while including the vibratory feature desired by many users.

It is to be understood that the above descriptions are provided for general illustration only, and that modifications can be made to the foundation within the general scope of the structure shown. For instance, different and additional padding layers can be interposed between the grid and the final cover, which might modify the resiliency of the foundation, but would not essentially change the resilient suspension of the vibrated metal grid.

Having described my invention, I claim:

1. A mattress foundation, comprising:

a rigid frame having a continuous horizontal top surface fixed thereto;

a first layer of resilient material overlying the top surface of said frame;

a planar grid freely resting on said first layer of resilient material, said grid being unattached to said frame;

and a powered vibrator unit fixed to said grid, said vibrator unit being physically clear of contact with said frame.

2. A foundation as claimed in claim 1, further comprising:

a second layer of resilient material overlying said grid.

3. A foundation as claimed in claim 2 wherein each of said first and second layers of resilient material comprises a sheet of foam resin material.

4. A foundation as claimed in claim 2 wherein each of said first and second layers of resilient material comprises a sheet of foam resin material unattached to either the frame or grid.

5. A foundation as claimed in claim 1 wherein the top surface of said frame has an upwardly open aperture formed through it which freely surrounds said vibrator unit.

6. A foundation as claimed in claim 1 wherein the frame has a peripheral bottom surface formed thereon parallel to said top surface;

said foundation further comprising:

a fabric cover enveloping and fitted over the top and sides of the frame, the first layer of resilient material and the grid, said cover being fastened to the frame about said bottom surface thereof.

7. A mattress foundation, comprising:

a rigid frame having a continuous horizontal top surface fixed thereto;

a first layer of resilient material overlying the top surface of said frame;

a planar grid resting on said first layer of resilient material, said grid including an area mounted to said frame by upright yieldable springs operably connected between the grid and the frame; and a powered vibrator unit fixed to said grid, said vibrator unit being physically clear of contact with said frame.

8. A foundation as claimed in claim 7 wherein the vibrator unit is fixed to said grid within said area.

* * * * *